US007462386B2

(12) United States Patent
Yamasaki et al.

(10) Patent No.: US 7,462,386 B2
(45) Date of Patent: Dec. 9, 2008

(54) LEATHER-LIKE SHEET AND METHOD FOR PRODUCTION THEREOF

(75) Inventors: Tsuyoshi Yamasaki, Kurashiki (JP); Hidekazu Andoh, Kurashiki (JP); Yoshihiro Tamba, Kurashiki (JP)

(73) Assignee: Kuraray Co., Ltd., Kurashiki (JP)

( * ) Notice: Subject to any disclaimer, the term of this patent is extended or adjusted under 35 U.S.C. 154(b) by 689 days.

(21) Appl. No.: 10/484,807

(22) PCT Filed: Jul. 23, 2002

(86) PCT No.: PCT/JP02/07418

§ 371 (c)(1),
(2), (4) Date: Jan. 30, 2004

(87) PCT Pub. No.: WO03/012190

PCT Pub. Date: Feb. 13, 2003

(65) Prior Publication Data

US 2004/0224122 A1 Nov. 11, 2004

(30) Foreign Application Priority Data

Jul. 31, 2001 (JP) ..... 2001-230706

(51) Int. Cl.
*B32B 33/00* (2006.01)

(52) U.S. Cl. ..... 428/91; 428/904; 428/220; 442/328; 442/340; 442/370; 427/264; 427/288

(58) Field of Classification Search ..... 428/904, 428/91, 220; 442/370, 328, 340; 427/264, 427/288

See application file for complete search history.

(56) References Cited

U.S. PATENT DOCUMENTS

| | | | |
|---|---|---|---|
| 5,503,899 | A | 4/1996 | Ashida et al. |
| 5,876,466 | A | 3/1999 | Nakashima et al. |
| 6,159,581 | A | 12/2000 | Yoneda et al. |
| 6,322,851 | B1 | 11/2001 | Adachi et al. |
| 6,451,404 | B1 | 9/2002 | Nobuto et al. |
| 6,479,153 | B1 | 11/2002 | Kato et al. |
| 6,517,938 | B1 | 2/2003 | Andoh et al. |
| 6,641,619 | B1 | 11/2003 | Nobuto et al. |

FOREIGN PATENT DOCUMENTS

| | | | |
|---|---|---|---|
| EP | 940492 | A1 * | 9/1999 |
| EP | 1031656 | A1 * | 8/2000 |
| JP | 7-102488 | | 4/1995 |
| JP | 10-1881 | | 1/1998 |
| JP | 10-102383 | | 4/1998 |
| JP | 2000-199184 | | 7/2000 |

* cited by examiner

*Primary Examiner*—Elizabeth M Cole
(74) *Attorney, Agent, or Firm*—Oblon, Spivak, McClelland, Maier & Neustadt, P.C.

(57) ABSTRACT

The leather-like sheet of the invention comprises a napped part of ultrafine fibers and a grainy part of nonporous elastic polymer randomly existing in the surface of a substrate prepared by infiltrating a porous polymer elastomer into a three-dimensionally intermingled nonwoven fabric of ultrafine fibers of not more than 0.5 dtex, and this is characterized in that the nonporous elastic polymer is infiltrated into the substrate to a depth thereof of from 5 to 20 μm from the surface of the substrate.

The production method of the invention is for producing a nubuck-type leather-like sheet of good surface abrasion resistance. A grainy part of resin and ultrafine fibers and a part of the ultrafine fibers are mingled on the surface of the substrate, and the sheet has an elegant and three-dimensional appearance like natural leather.

12 Claims, No Drawings

LEATHER-LIKE SHEET AND METHOD FOR PRODUCTION THEREOF

TECHNICAL FIELD

The present invention relates to a leather-like sheet and a method for production thereof, in particular, to a nubuck-type leather-like sheet for automobile sheets and interiors, which is resistant to surface abrasion and has a soft and high-grade surface touch and a three-dimensional appearance, and to a method for production thereof.

BACKGROUND ART

Various proposals have heretofore been made for grain type leather-like sheets, and various materials have been produced for them. Many of these have a patterned indented surface of embossed pattern, therefore lacking difference of a glossy feel and a color tone. Specifically, their appearance is monotonous with no three-dimensional and solid feel, and they are unsatisfactory as a material for producing commercial products with high-grade appearance. Recently, improving these have been repeatedly tried, and various proposals have been made for them.

One proposal is to make the valleys of an embossed pattern matted to produce a gloss difference between the valleys and the hills of the embossed pattern, and it is to make the hills glossier to produce a three-dimensional appearance, as in JP-B 59-34821 and 59-33715. Another proposal is to change the color tone between the valleys and the hills of an embossed pattern to thereby make the pattern have a color difference between them and a three-dimensional appearance, as in JP-A 63-42980. Still another proposal is to produce suede-like leather that has a three-dimensional appearance and a color difference by applying a solution or dispersion of an elastic polymer onto the napped face of suede-like leather in the creped pattern shape, as in JP-B 5-45717 and 3-42358. Also proposed is a napped and grainy fibrous sheet produced by forming an embossed pattern on the surface coating layer of a fibrous sheet followed by removing the coating layer on the hills of the pattern by buffing it to thereby raise a fibrous nap on the thus-processed sheet, as in JP-A 63-50580. These produce some interesting appearances, but the embossed pattern formed by these could not substantially have leather-like roughness of valleys and hills and therefore could not express a satisfactory three-dimensional appearance and, in addition, its abrasion resistance is not good.

For improving the surface abrasion resistance and the fluff-dropping resistance of napped fibrous materials, proposed is a method of melting a part of the polymer around the nap roots with a solvent for the polymer to thereby fix the nap roots on the surface, as in JP-A 57-154468. This is effective in some degree for improving the fluff-dropping resistance and the pilling resistance of napped fibrous materials for clothes, but is still impracticable for automobile sheets and interiors that often receive strong abrasion.

On the other hand, JP-A 5-78986 discloses nubuck-type artificial leather of good abrasion resistance, which is produced by infiltrating a polymer elastomer into a melt-blown nonwoven fabric of intermingled ultrafine fibers having a mean fiber diameter of from 0.1 to 6 μm in such a manner that the amount of the polymer elastomer infiltrated into the surface layer side of the fabric is larger than that into the back layer side thereof so as to reinforce the holding power of the ultrafine fibers therein. In this case, however, the ultrafine fibers are firmly bonded to the polymer elastomer and the artificial leather produced could hardly have a soft hand like a natural leather-like.

JP-B 56-16235 discloses an improved method of controlling the bonding of ultrafine fibers to a polymer elastomer of a fibrous material to reduce the dropping of ultrafine fibers with ensuring the soft hand of the fibrous material, which comprises infiltrating a polymer elastomer into a nonwoven fabric of conjugated fibers of two types of polymer substances that differ in the solubility in solvent, before or after one component of the conjugated fibers is extracted away with a solvent to give ultrafine fibers.

JP-A 3-137281 discloses napped artificial leather produced by infiltrating a solution of polyurethane in dimethylformamide (hereinafter this may be abbreviated to DMF) into a nonwoven fabric sheet that is produced by intermingling and integrating a sheet of ultrafine staple fibers having a single fiber fineness of at most 0.5 deniers with a woven or knitted fabric followed by wet-solidifying it, or by infiltrating an aqueous polyurethane emulsion thereinto followed by dry-solidifying, and thereafter fluffing the surface of the thus-processed fibrous sheet with sand paper. In this case, the dry-solidification ensures firm bonding between the ultrafine fibers and the polymer elastomer and is therefore effective in some degree for preventing the dropping of the ultrafine fibers. However, this is defective in that the hand of the artificial leather produced is hard. Another problem with it is that, if the amount of the polymer elastomer to be applied to the fibrous sheet is reduced so as to make the processed sheet have a soft hand, then the surface abrasion resistance of the artificial leather produced lowers.

As mentioned hereinabove, the conventional suede-like artificial leather may have a surface appearance like a natural suede with three-dimensional high-quality expression and a soft hand, but could not have good surface abrasion resistance durable to long-term use for automobile sheets and interiors.

An object of the present invention is to overcome the above-mentioned drawbacks of conventional artificial leather used in the field of automobile sheets and interiors, and to provide artificial leather having good surface abrasion resistance and good appearance and hand like a natural nubuck suitable to use for them.

DISCLOSURE OF THE INVENTION

We, the present inventors have assiduously studied to provide a leather-like sheet that solves the problems and has good surface abrasion resistance and an elegant three-dimensional appearance, and, as a result, have completed the present invention.

Specifically, the invention is a leather-like sheet which comprises a napped part of ultrafine fibers and a grainy part of nonporous elastic polymer randomly existing in the surface of a substrate prepared by infiltrating a porous polymer elastomer into a three-dimensionally intermingled nonwoven fabric of ultrafine fibers of not more than 0.5 dtex, and which is characterized in that the nonporous elastic polymer is infiltrated into the substrate to a depth thereof of from 5 to 20 μm from the surface of the substrate. Preferably, the grainy part in the leather-like sheet comprises substantially the ultrafine fibers and the nonporous elastic polymer randomly existing therein. Also preferably, the areal ratio of the grainy part to the napped part on the surface of the leather-like sheet, grainy part/napped part is from 90/10 to 50/50; and the surface abrasion loss of the sheet is at most 10 mg in 10,000 cycles in a Martindale method.

The invention is also a method for producing a leather-like sheet, which comprises the following steps <1> to <3> in the order of <1 >, <2> and <3>:

<1> a step of applying a penetrant to the napped surface of a substrate comprising a nonwoven fabric of three-dimensionally intermingled ultrafine fibers of not more than 0.5 dtex and a porous polymer elastomer infiltrated into it;

<2> a step of discontinuously applying an aqueous emulsion of an elastic polymer to the penetrant-processed napped surface of the substrate followed by dry-solidifying it in a nonporous state;

<3> a step of processing the resulting leather-like sheet in warm water to make it shrunk at the shrinkage rate from 2 to 10 % both in the direction of length and in the transverse direction thereof.

BEST MODES OF CARRYING OUT THE INVENTION

Not specifically defined, the fibers that constitute the invention may be any known synthetic fibers, natural fibers, regenerated fibers or semi-synthetic fibers, for example, cellulosic fibers, acrylic fibers, polyester fibers, polyamide fibers, polyolefin fibers, polyvinyl alcohol fibers, etc. One type or more different types of such fibers may be used herein either singly or as combined.

For ensuring good handlability and good softness like a natural leather, hand and touch, the fineness of the surface-napping fibers must be at most 0.5 dtex; and for better appearance, it is preferably at most 0.2 dtex. Especially preferably, the fibers that constitute the substrate layer in the invention are ultrafine fibers comprising a single fiber of not larger than 0.2 dtex, and a few to hundreds of such ultrafine fibers are bundled into an ultrafine fiber bundle having a total decitex of the ultrafine fiber bundle unit of from 0.5 to 50 dtex, in view of the softness and the napping property of the ultrafine fiber bundles for the layer. If the total decitex thereof is smaller than 0.5 dtex, then the fiber bundles could not be well napped and will be ineffective for good writing effect and they could not produce good surface abrasion resistance; but if larger than 50 dtex, then they tend to have a tough hand.

The ultrafine fiber bundles of the type may be obtained by mixing and melt-spinning at least two different types of polymers immiscible with each other through a spinneret with drawing the spun fibers, or separately melting the polymers, combining the polymer melts before a spinneret and spinning the thus-combined melt through the spinneret with drawing to thereby produce the so-called ultrafine fibers-forming fibers of which the cross section has a sea-island or laminar profile structure, followed by removing the sea component polymer from the fibers or by peeling the fibers at the interlayers thereof.

The island component polymer to constitute the ultrafine fibers-forming fibers includes polyamides such as nylon 6, nylon 66, nylon 610, nylon 612; and polyesters such as polyethylene terephthalate, polypropylene terephthalate, polybutylene terephthalate; and the sea component polymer includes polyethylene, polystyrene and their copolymers partly comprising the repetitive units of the polymer as the constitutive units, and copolyesters.

The fibers are carded into a web, and the resulting web is needle-punched or processed with water jets to be a three-dimensionally intermingled nonwoven fabric. The unit weight of the three-dimensionally intermingled nonwoven fabric is preferably from 500 to 1500 g/m$^2$. A porous polymer elastomer is infiltrated into the three-dimensionally intermingled nonwoven fabric. The polymer elastomer and the method of applying it to the nonwoven fabric may be any known resin and method. The polymer elastomer includes, for example, polyurethane resins, polyvinyl chloride resins, polyacrylic resins, polyamino acid resins, silicone resins, and their copolymers and mixtures, and it may be selected from these in accordance with its object and use. Polyurethane resins are preferred for the polymer elastomer in view of enhancement their softness and fulfillment.

One preferred example of polyurethane is a segmented polyurethane that is obtained by reacting at least one polymer diol with a diisocyanate compound and a low-molecular chain-extending,agent, for which the polymer diol has a number-average molecular weight of from 500 to 5000 and is selected from a group of polyester diols obtained through reaction of a diol and a dicarboxylic acid or its ester-forming derivative and their block copolymer diols with polyethers, and polylactone diols, polycarbonate diols and polyether diols. Preferably, at least a part of the diol compound that is used for producing the polyester diols has from 6 to 10 carbon atoms for ensuring the durability and the leather-like feel of the sheet. The diol compound of the type includes, for example, 3-methyl-1,5-pentanediol, 1,6-hexanediol, 2-methyl-1,8-octanediol, 1,9-nonanediol, and 1,10-decanediol. Typical examples of the dicarboxylic acid are aliphatic dicarboxylic acids such as succinic acid, glutaric acid, adipic acid, azelaic acid, sebacic acid; and aromatic dicarboxylic acids such as terephthalic acid, isophthalic acid.

Polymer diols having a number-average molecular weight of smaller than 500 are unfavorable since the sheets produced by the use of these could not be flexible and could not have a hand like a natural leather. On the other hand, polymer diols having a number-average molecular weight of larger than 5000 could not give artificial leather with well balanced flexibility, durability, heat resistance and hydrolysis resistance since the urethane group concentration in the polyurethane decreases. The low-molecular chain-extending agent is, for example, a low-molecular compound having two active hydrogens such as ethylene glycol, propylene glycol, butanediol, hexanediol, ethylenediamine, isophoronediamine. The diisocyanate compound includes, for example, aromatic compounds such as 4,4'-diphenylmethane diisocyanate, tolylene diisocyanate, phenylene diisocyanate, xylylene diisocyanate; aliphatic compounds such as typically hexamethylene diisocyanate; and alicyclic compounds such as typically 4,4'-dicyclohexylmethane diisocyanate, isophorone diisocyanate. If desired, pigment, dye, coagulation regulator and stabilizer may be added to the polymer elastomer for use in the invention. Also if desired, two or more different types of polymers may be combined for use herein.

The method for infiltrating such a porous polymer elastomer into a three-dimensionally intermingled nonwoven fabric in the invention is not specifically defined. For example, preferred are the so-called wet coagulation method that comprises infiltrating a DMF solution of polyurethane such as that mentioned above into the nonwoven fabric, and solidifying the polyurethane inside the nonwoven fabric in a poor solvent or non-solvent for polyurethane such as a mixture of DMF/water or water alone; and the so-called dry coagulation method that comprises infiltrating a dispersion prepared by dispersing polyurethane in a mixture of a non-solvent such as water and a low-boiling-point solvent such as methyl ethyl ketone (hereinafter this may be abbreviated to MEK)/toluene, into the nonwoven fabric, and heating and drying it to thereby predominantly evaporate the low-boiling-point solvent in the liquid so as to gradually increase the ratio of the non-solvent in the liquid and to solidify the polyurethane. More preferred is the wet coagulation method as it readily produces a dense and uniform porous structure to give a soft hand. For making the sheet of the invention have a soft hand like a natural leather, it is desirable that the ratio by weight of the ultrafine fibers that constitute the three-dimensionally intermingled nonwoven fabric for the substrate layer to the polymer elastomer falls between 30/70 and 95/5, more preferably between 50/50 and 90/10.

If the ratio of the fibers in the substrate layer is too low, the sheet may have a rubber-like hand; but if the ratio of the fibers is too high, the sheet may have a paper-like feel, and intended natural leather-like feel will be difficult to obtain.

In cases where the fibers that constitute the three-dimensionally intermingled nonwoven fabric are ultrafine fibers-forming fibers, then they must be converted into ultrafine fibers or their bundles. Forming such ultrafine fibers or their bundles may be effected in any stage before or after the step of infiltrating a polymer elastomer into the nonwoven fabric. For converting the ultrafine fibers-forming fibers into ultrafine fibers or their bundles, preferably employed is a method of processing the fibers with a chemical that serves as a non-solvent for the ultrafine fibers to be formed and for a porous polymer elastomer and serves as a solvent or a decomposing agent for the component to be removed (e.g., the sea component) of the ultrafine fibers-forming fibers. When the ultrafine fibers-forming fibers are splittable fibers, also preferred is a method of processing the fibers with a chemical that acts to swell one component of the splittable fibers, a swelling agent or physically or mechanically processing the fibers to thereby split the fibers into the constitutive components so as to convert them into ultrafine fibers. Thus processed, the substrate obtained comprises a three-dimensionally intermingled nonwoven fabric of the ultrafine fibers and a porous polymer elastomer.

For ensuring a good balance between the soft hand and the outward appearance the invention, it is desirable that the ultrafine fibers-forming fibers are converted into ultrafine fibers or their bundles after a porous polymer elastomer has been infiltrated into them.

The thickness of the substrate layer thus obtained is preferably from 0.3 to 2.0 mm for readily obtaining sheets like a natural leather. The unit weight is preferably from 120 to 1600 g/m$^2$, more preferably from 200 to 1200 g/m$^2$ for better leather-like hand and fulfillment of the sheets to be obtained herein.

Next, the surface of the substrate is buffed with sand paper or needles to thereby make the ultrafine fibers thereon napped, and a fibrous nap of the ultrafine fibers is thus formed on the surface of the substrate. Preferably, the ultrafine fibers are napped to give a graceful appearance of uniform suede-like writing effect. Therefore, the paper to be used for it preferably has a fine texture, more preferably a fine texture of #240 or more. For napping the ultrafine fibers, employable is any known condition. For example, the buffing contact pressure is reduced with high-speed rotation, or the size of the grains for polishing sand is reduced.

The napping condition, that is, the napping length of the fibers on the surface of the substrate vary depending on the use of the product and the necessary appearance thereof. In general, thick fibers are napped long while thin fibers are napped short for more effectively improving the surface writing effect of the napped substrate.

In cases where fine fibers having a fineness of not larger than 0.1 dtex are napped and the length of the napped fibers is shortened, it is desirable that the roots of the fibers are once fixed and then the fibers are buffed. For fixing the roots of the fibers, it is desirable that a solvent having an affinity for the porous polymer elastomer to form the substrate surface is applied to them. The solvent that has an affinity for the porous polymer elastomer is one capable of dissolving or swelling the porous polymer elastomer. In case where the porous polymer elastomer is polyurethane, the solvent for it is a single solvent of dimethylformamide, dimethylsulfoxide, tetrahydrofuran or cyclohexanone, or a mixed solvent of two or more of these.

The amount of the solvent to be applied varies depending on the fineness of the fibers, but is preferably such that the solvent may form a thin film on the surface of the substrate for ensuring uniform napping of the substrate. In general, the amount is at most 50 g/m$^2$, preferably from 5 to 35 g/m$^2$. If the coating amount is too small, the fibers will fluff too long, but if too large, the fibers will fluff too short. In addition, if the coating amount is too large, another problem with it is that the surface of the substrate may have a tough hand. For applying the solvent to the surface of the substrate layer, employable is any method of gravure coating, knife-coating, spraying or transfer printing. For ensuring uniform coating,preferred is gravure coating. In that manner, the fluffing length of the fibers in the surface may be suitably controlled by selecting the buffing condition and the coating amount of the solvent with taking the fineness of the ultrafine fibers into consideration. The solvent treatment produces uniform nap, and a nonporous elastic polymer is discontinuously applied to the napped surface as will be described hereinunder. When observed, therefore, the leather-like sheet surface of the invention sampled anywhere (within a circle having a diameter of 1 mm) is seen to have a mixed condition of graining and fibrous napping.

Next, a penetrant is applied to the thus-napped substrate (suede-type leather-like sheet). The penetrant to be used in the invention is a penetrable surfactant, for which, for example, usable are any ones known in the art as a wetting agent, a penetrating agent or a leveling agent. Of those, preferred is one or more selected from sulfonic acid salt-type anionic surfactants such as sodium di-2-ethylhexyl sulfosuccinate, sodium dioctyl sulfosuccinate, sodium dodecylbenzenesulfonate; sulfate salt-type anionic surfactants such as sodium lauryl sulfate, sodium butyl sulfato-oleate, sodium dibutylnaphthalenesulfonate; polyethylene glycol-type nonionic surfactants having an HLB (hydrophilic-lipophilic balance) value of from 6 to 16 such as polyethylene glycol mono-4-nonylphenyl ether, polyethylene glycol mono-octyl ether, polyethylene glycol monodecyl ether; fluorine-containing surfactants, and silicone-type surfactants. For applying the penetrant to the substrate, employable is any method of gravure coating, knife-coating, spraying, dipping or transfer printing. For ensuring uniform coating, preferred is dipping or gravure coating. The amount of the penetrant to be applied is preferably between 0.5 and 5.0 g/m$^2$, more preferably between 1.0 and 3.0 g/m$^2$ in terms of the solid content of the coating amount thereof for good hand and good surface properties of the leather-like sheet to be obtained herein. If the amount is smaller than 0.5 g/m$^2$, the nonporous elastic polymer could not uniformly sufficiently penetrate into the depth of the substrate layer; but even if larger than 5.0 g/m$^2$, the penetrating effect will change little and the coating amount will increase to no purpose.

Preferably, the substrate with a penetrant applied thereto has a water drop disappearing time of not longer than 20 seconds, more preferably not longer than 10 seconds, when a water drop is put onto the surface of the substrate. The meaning of the water drop disappearing time is as follows: Immediately after a water drop is put onto the surface of a substrate, it is deformed and penetrates into the substrate layer, and it could no more seen with the naked eye even though its trace is seen to remain on the surface of the substrate. If the water drop disappearing time is longer than 20 seconds, the penetration of the aqueous emulsion of the nonporous elastic polymer described below, into the substrate will be poor, and the aqueous emulsion could not uniformly and efficiently cover the napped substrate to penetrate thereinto.

Next, an aqueous emulsion of a polymer elastomer, nonporous elastic polymer is applied to the napped surface of the substrate coated with the penetrant, and the polymer emulsion must penetrate into the substrate layer to a depth thereof of from 5 to 20 μm from the surface of the substrate.

The aqueous emulsion of a nonporous elastic polymer for use in the invention may be any one that is elastic after removal of water from it. For example, it includes polyurethane emulsion, acrylic emulsion, SBR emulsion and NBR emulsion. Of those, preferred is polyurethane emulsion in view of the softness, the strength and the durability. For the polyurethane emulsion, usable are any of polyester-type, polyether-type and polycarbonate-type polyurethanes. For the products of good durability in some degree, preferred are polyether-type and polycarbonate-type polyurethane emulsions. Of those, more preferred are non-yellowing polyurethanes in which the diisocyanate to form the hard segments is an aliphatic diisocyanate, as they do not discolor and fade.

For making the aqueous emulsion penetrate into the substrate layer at around the surface of the layer, for example, tried is a method of dipping a substrate in an aqueous emulsion and letting the emulsion migrate to the surface of the substrate layer while it is dried. However, the emulsion applied to a substrate in such a dipping method tends to distribute into the substrate in such a manner that its amount at the upper and lower outermost surface layers of the substrate is large while that in the center part thereof is small. To solve this problem, tried is a method of drying the dipped substrate only on one surface thereof so that the polymer emulsion applied to the substrate may selectively migrate to only the other one surface of the substrate. Even in this method, however, the resin amount in the dried one surface of the substrate could be large while that in the other surface thereof may be small, or in other words, there is no difference between the two methods in that the substrate dipped in the aqueous emulsion of resin shall have the resin anywhere in the substrate layer. Accordingly, even when the necessary amount of resin is localized in the surface of the substrate layer by dipping the substrate in a resin emulsion, the resin shall exist anywhere in the dipped substrate layer and, as a result, the substrate shall have a tough hand and is therefore unfavorable to the invention.

In a knife-coating method, the entire surface of the substrate is coated with resin, and the thus-coated substrate could hardly have a nubuck-like appearance of a mixture of a grainy part and a napped part like that in the invention. In the invention, an aqueous emulsion is applied to the surface of a substrate in a gravure-coating method to thereby make the surface of the substrate have an emulsion-coated part and a non-coated part. The aqueous emulsion in the coated part is led into the substrate by the penetrant existing on and inside the substrate, and then dried and solidified at 100 to 170° C. in a mode of dry solidification to thereby form a grainy part that comprises the nonporous elastic polymer on the surface of the substrate, but the non-coated part of the substrate is kept napped.

The aqueous emulsion penetrates into the space between the fibers and the porous polymer elastomer in the substrate layer and into the space of the porous polymer elastomer therein owing to the penetrant. Therefore, when the amount of the aqueous emulsion to be applied is controlled depending on the density of the substrate layer so that the nonporous elastic polymer could penetrate into the substrate layer to a depth thereof of from 5 to 20 μm from the surface of the substrate layer, then a nubuck-type leather-like sheet having a mixed appearance of a grainy part and a napped part can be obtained and it has good surface abrasion resistance and good hand. Preferably, the emulsion is made to penetrate into a depth of from 10 to 15 μm of the substrate layer for stable production of the nubuck-type leather-like sheet.

If the nonporous elastic polymer penetrates to a depth of smaller than 5 μm, then the amount of the resin for fixing the fibers in the surface layer part of the substrate is not enough and the napped fibers could not be fully prevented from dropping in abrasion, and, as a result, the sheet could not have good surface abrasion resistance enough for automobile sheets and interiors. On the other hand, if the polymer penetrates to a depth of larger than 20 μm, then the surface abrasion resistance of the sheet will be good but the sheet will have a hard hand as the leather-like sheet and, in addition, the surface part of the substrate is hard and is readily folded to be rough.

Preferably, the resin amount of the aqueous emulsion to be applied falls between 3 and 30 g/m$^2$ for better balance between the penetrability of the nonporous elastic polymer and the preferred areal ratio of the grainy part to the napped part to be mentioned below. Specifically, the areal ratio of the grainy part to the napped part in the surface of the leather-like sheet of the invention, grainy part/napped part preferably falls between 90/10 and 50/50. If the ratio of the grainy part is larger than the range, the surface touch of the sheet will be like that of grain type leather-like sheet; but if the ratio of the napped part is larger than the range, the surface touch of the sheet will be like that of suede-type leather-like sheet.

Preferably, the surface abrasion loss of the leather-like sheet of the invention is at most 10 mg in 10,000 cycles in a Martindale method. If the abrasion loss thereof is over 10 mg, the surface abrasion resistance of the sheet is not good and particularly the sheet could not be safely used for automobile sheets and interiors. The abrasion loss of the sheet much depends on the surface abrasion resistance of the substrate layer. Depending on its penetration condition, the nonporous elastic polymer indispensable in the invention improves the surface abrasion resistance of the sheet and reduces the abrasion loss of the sheet. Improving the surface abrasion resistance of the sheet may be attained by using a nonporous elastic polymer of good abrasion resistance and by suitably selecting the penetration depth of the polymer, the coating amount thereof and the coating condition thereof within the range mentioned above and the range to be mentioned hereinunder.

In the invention, the substrate surface that is napped to have napped ultrafine fibers entirely therein is microscopically in such a mingled condition that the napped ultrafine fibers are partly in the substrate surface while the other part of the substrate layer with no napped ultrafine fibers therein is exposed out, and the grainy part formed by discontinuously applying a nonporous elastic polymer comprises a part where the napped ultrafine fibers are taken into it to form the silver tone and a part where the polymer is on the substrate layer also to form the silver tone. For realizing the good surface abrasion resistance in one preferred embodiment of the invention as above, it is desirable that most of the grainy part is in the former condition, or that is, it is in a mixed condition of the nonporous elastic polymer and the ultrafine fibers and the structure is firmly integrated with the structure of the substrate layer. Needless-to-say, even in the grainy part of the latter case, the nonporous elastic polymer penetrates into the substrate layer and is fully integrated with the structure of the substrate layer. Therefore, even when the grainy part of the latter case spotwise exists in the surface of the leather-like sheet in which the grainy part of the former case substantially occupies most of the surface of the substrate, it will not have any substantial influence on the obtained surface abrasion resistance.

In the invention, a grainy part may spotwise exist on the continuous napped part of the substrate layer, or a napped part may spotwise exist on the continuous grainy part thereof, or both a napped part and a grainy part may spotwise exist in the substrate layer. In short, in the invention, both the napped part and the grainy part shall exist in the surface of the substrate layer. All of these are generically referred to herein as "discontinuous".

For the mixed condition of a napped part and a grainy part in the invention, it is desirable that both a napped part and a grainy part are found in a circle having a diameter of 5 mm, more preferably a diameter of 1 mm in any desired part of the surface of the leather-like sheet.

In the invention, an aqueous emulsion of a nonporous elastic polymer is used for forming the grainy part. If an organic solvent solution of a nonporous elastic polymer is used in place of the aqueous emulsion thereof, the napped part of the surface of the leather-like sheet produced may adhere to the porous polymer elastomer in the substrate layer and may be thereby fixed by the nonporous elastic polymer therein. If so, the sheet produced will be grain type leather-like sheet and could not satisfy the object and the effect of the invention.

Next, the sheet is processed in warm water. Before processed so, the sheet may be hot pressed for embossing to make its surface have an embossed pattern. For hot embossing the sheet, preferred is a method of using an embossing roll having an embossing pattern on its surface and hot pressing the roll surface against the surface of the leather-like sheet. The surface embossed pattern may be the start point of shrinkages to be formed through the treatment in warm water, and the pattern may be suitably selected in accordance with the object. The treatment in warm water may be also for coloring the sheet. For example, the sheet is treated in an aqueous solution containing any of disperse dye, acidic dye, metal complex-containing dye or sulfide dye. The treatment machine in warm water may be effected in any manner, using any of wince dyeing machine, jigger dyeing machine or high-pressure jet dyeing machine. Using a high-pressure jet dyeing machine is especially effective, in which the leather-like sheet is passed through a narrow nozzle along with a hot water jet therethrough. The advantages of the method are that the napped parts not fully fixed in the grainy part of the leather-like sheet of the invention are further napped by the external force of the high-pressure jet dyeing machine to thereby further increase the napped ultrafine fibers and the nonporous elastic polymer in the grainy part, and the processed sheet may have soft and natural shrinks therefore having a feel of three-dimensional fulfillment.

For making it have shrinks like a natural leather, the sheet is, after processed in warm water, shrunk by from 2 to 10% both in the machine direction and in the cross direction thereof before processing. For making it shrunk to that effect, the leather-like sheet is tentered (extended in the width) suitably depending on the thickness and the unit weight thereof. For example, when the substrate that comprises a porous polymer elastomer and a three-dimensionally intermingled nonwoven fabric has a thickness of from 0.8 to 1.5 mm and a unit weight of from 400 to 1500 g/m$^2$, and when the ultrafine fibers-forming fibers that constitute the substrate are processed with a solvent or a decomposing agent to convert them into ultrafine fibers, then the substrate is, after the solvent or the decomposing agent used has been removed from it, dried at 100 to 150° C. with tentering it by from 5 to 15% of the original width of the substrate before drying. Next, the sheet is subjected to the above-mentioned treatment in warm water (including dyeing treatment) whereby the wet leather-like sheet is back-shrunk by from 5 to 60% of the extended width of the dried sheet. The sheet is again dried at 120 to 150° C. with extending it by 10% that corresponds to the back-shrunk width thereof, and, as a result, the width change before and after the warm water treatment may correspond to a shrinkage of from 2 to 10%.

The intended degree of shrinkage of the sheet may be suitably determined in accordance with the tentering degree and the condition for warm water treatment. Regarding the condition for warm water treatment, the sheet may be generally processed in a warm water bath at 40 to 150° C. for 1 to 90 minutes.

The shrink pattern like a natural leather of the sheet of the invention may be controlled in point of the size thereof and of the depth of the valleys thereof, by suitably selecting the ratio of the nonporous elastic polymer that exists locally in the surface layer part, the penetration depth and the degree of shrinkage in warm water treatment, and the sheet may be a nubuck-type leather-like sheet having a good feel of three-dimensional fulfillment. If the degree of shrinkage is smaller than 2%, the three-dimensional feel will be poor; but if larger than 10%, the depth of the valleys of the embossed pattern will be too large and the quality will be therefore bad. Accordingly, the degree of shrinkage is preferably from 4 to 7% both in the machine direction and in the cross direction, before and after the warm water treatment.

The sheet thus obtained herein may be optionally crumpled and/or dressed to be nubuck-type artificial leather having a softer and better fulfillment and having better surface abrasion resistance.

EXAMPLES

Embodiments of the invention are described below with reference to the following Examples, to which, however, the invention is not limited. In the Examples, part and % are all by weight unless otherwise specifically indicated.

[Determination of Penetration Depth of Nonporous Layer]

Using an electronic microscope, a picture (×500) of the cross section of a leather-like sheet is taken. The penetration condition of the nonporous elastic polymer in the sheet is observed at intervals of 2 mm cut in the direction vertical to the thickness direction of the sheet. Three points are selected from the part where the penetration depth is the smallest from the surface of the substrate layer, and three points are selected from the part where the penetration depth is the largest from it. The average of the thus-selected penetration depths is obtained, and this indicates the penetration depth of the nonporous layer.

[Determination of Abrasion Loss]

Determined according to JIS L 1096 (6.17.5E method, Martindale method). The pressure load is 12 kPa (gf/cm$^2$); and the abrasion frequency is 10,000. Four points of the sample are measured, and their data are averaged to indicate the abrasion loss of the sample.

[Thickness of Fibers]

Using an electronic microscope, the fibers are observed at a magnification of from 500 to 2000 times or so. The thickness of the fibers is derived from the measured diameter of the fibers.

Example 1

An intermingled nonwoven fabric of bicomponent fibers comprising polyethylene terephthalate (island component) and polyethylene (sea component) and having a fineness of 6 dr was dipped in a DMF solution of 14% polyether polyurethane, and then dipped in an aqueous solution of DMF to solidify the polyurethane.

Next, this was processed in toluene to dissolve and remove polyethylene from the fibers. After the removal, the intermingled nonwoven fabric was dried at 140° C. with tentering it by 10% to the nonmoven fabric. Porous polyurethane was thus infiltrated into the three-dimensionally intermingled nonwoven fabric of ultrafine fiber bundles of polyethylene terephthalate (having a mean single fiber fineness of 0.02 dtex), and the resulting substrate had a thickness of 1.3 mm and a unit weight of 470 g/m$^2$.

Using a 200-mesh gravure roll, a mixed solvent of DMF/cyclohexanone (50/50) was applied to one surface of the substrate, and its amount was 18 g/m$^2$. Thus coated, the substrate was dried. The mixed solvent-coated surface of the substrate was then buffed with sand paper having a grain size of #400 to thereby nap the fibers in the surface. Thus processed, the substrate had a napped structure of ultrafine fibers.

Next, the substrate was dipped in a penetrant, aqueous 1.5% solution of Polyf low (by KYOEISHA Chemical Co., LTD) and then dried to thereby make the napped substrate have 1.5 g/m$^2$, in terms of the solid content thereof, of the penetrant applied thereto. Using a 70-mesh gravure roll, an aqueous emulsion of 15%, in terms of the solid content thereof, of VONDIC 131ONS (by DaiNippon Ink and Chemicals, incorporated) was applied once to the substrate, and its amount was 7.5 g/m$^2$ in terms of the solid content thereof applied to the substrate. Thus coated, the substrate was dried at 150° C. for 40 seconds. Next, using a high-pressure jet-dyeing machine, the substrate was processed in warm water at 130° C. for 60 minutes while dyed with a disperse dye of dark brown, then washed, reduced, oxidized, neutralized and further washed with warm water, and thereafter this was dried at 130° C. while tentered by 10% of the original width. Regarding its dimension based on the original dimension before the dyeing treatment, the thus-processed sheet was shrunk by 3% in the machine direction and by 6% in the cross direction. Using a crumpling machine that simulates hand crumpling, this was mechanically crumpled to be a leather-like sheet.

The surface of the thus-obtained leather-like sheet comprised the nonporous elastic polymer, in which the areal ratio of the grainy part with ultrafine fibers in most of it to the napped part of the ultrafine fibers, grainy part/napped part was 70/30, and every circular area having a diameter of 1 mm contained both the napped part and the grainy part. The leather-like sheet was a nubuck-type one having a three-dimensional solid appearance with natural-leather like shrinks and having a soft and high-quality feel. Observing the cross section of the sheet with an electronic microscope confirmed that the nonporous elastic polymer reached the depth of from 8 to 13 μm of the substrate layer from the surface thereof, and the mean penetration depth of the polymer was 11 μm. In the polymer penetration part, the nonporous elastic polymer was mixed with the polyurethane resin and the ultrafine fibers existing inside the substrate layer. The abrasion loss of the surface of the nubuck-type leather-like sheet was measured according to a Martindale method. In 10,000 cycles, the loss was 4 mg, and the surface was not pilled at all. This proves that the sheet is enough for automobile sheets and interiors.

Example 2

A leather-like sheet was produced in the same manner as in Example 1, for which, however, the warm water treatment with dyeing was effected by the use of a jigger dyeing machine. Regarding its dimension based on the original dimension before the dyeing treatment, the sheet produced herein was shrunk by 3% in the machine direction and by 6% in the cross direction. Using a crumpling machine that simulates hand crumpling, this was mechanically crumpled to be a leather-like sheet.

In the surface of the thus-obtained leather-like sheet, the areal ratio of the grainy part of the nonporous elastic polymer to the napped part of the ultrafine fibers, grainy part/napped part was 65/35, and every circular area having a diameter of 1 mm contained both the napped part and the grainy part. The leather-like sheet was a nubuck-type one having a three-dimensional solid appearance with natural-leather like shrinks and having a soft and high-quality feel. Observing the cross section of the sheet with an electronic microscope confirmed that the nonporous elastic polymer reached the depth of from 8 to 13 μm of the substrate layer from the surface thereof, and the mean penetration depth of the polymer was 11 μm. In the polymer penetration part, the nonporous elastic polymer was mixed with the polyurethane resin existing inside the substrate layer or the ultrafine fibers.

The abrasion loss of the surface of the nubuck-type leather-like sheet was measured according to a Martindale method. In 10,000 cycles, the loss was 4 mg, and the surface was not pilled at all. This proves that the sheet is enough for automobile sheets and interiors.

Comparative Example 1

A leather-like sheet was produced in the same manner as in Example 1, for which, however, the substrate was processed neither with a penetrant nor with an aqueous emulsion. Regarding its appearance, the obtained sheet did not have an elegant nubuck feel of a mixture of a grainy part and a napped part, and its entire surface comprised of napped ultrafine fibers. This was a type of ordinary suede-type leather-like sheet. In addition, since no non-elastic polymer existed locally at around the surface layer of the sheet, the abrasion loss of the sheet measured according to a Martindale method was 55 mg in 10,000 cycles. After the sheet was much worn, its surface pilling state was noticeable.

Comparative Example 2

A penetrant was not applied to the surface of the napped substrate prepared in Example 1. Using a 70-mesh gravure roll, an aqueous emulsion of 15%, in terms of the solid content thereof, of VONDIC 131ONS (by DaiNippon Ink and Chemicals, incorporated) was applied once to the substrate, and then dried at 150° C. for 40 seconds. Next, using a high-pressure jet-dyeing machine, the substrate was processed in warm water at 130° C. for 60 minutes while dyed with a disperse dye of dark brown, then washed, reduced, oxidized, neutralized and further washed with warm water, and thereafter this was dried at 130° C. while tentered by 10% of the original width. Regarding its dimension based on the original dimension before the dyeing treatment, the thus-processed sheet was shrunk by 3% in the machine direction and by 7% in the cross direction. Using a crumpling machine that simulates hand crumpling, this was mechanically crumpled to be a leather-like sheet.

In the surface of the thus-obtained leather-like sheet, the areal ratio of the grainy part comprising a mixture of the nonporous elastic polymer and the ultrafine fibers to the napped part of the ultrafine fibers, grainy part/napped part was 80/20, and every circular area having a diameter of 1 mm contained both the napped part and the grainy part. The leather-like sheet was a nubuck-type one having a three-dimensional solid appearance with shrinks like natural leather and having a soft and high-quality hand. Observing the cross section of the sheet with an electronic microscope confirmed that the nonporous elastic polymer reached the depth of only from 1 to 3 μm of the substrate layer from the surface thereof, and the mean penetration depth of the polymer was only 2 μm. The abrasion loss of the surface of the nubuck-type leather-like sheet was measured according to a Martindale method. In 10,000 cycles, the loss was 28 mg, and a part of the surface was much pilled. It is understood that the sheet is not enough for automobile sheets and interiors.

Comparative Example 3

The surface of the napped substrate that had been prepared in Example 1 was dipped in a penetrant, aqueous 1.5% solution of Polyflow (by KYOEISHA Chemical Co.,LTD) and then dried to thereby make it have 1.5 g/m$^2$, in terms of the solid content thereof, of the penetrant applied thereto. Using a 50-mesh gravure roll, an aqueous emulsion of 15%, in terms of the solid content thereof, of VONDIC 1310NS (by DaiNippon Ink and Chemicals, incorporated) was applied twice to the substrate, and its amount was 33 g/m$^2$ in terms of the solid content thereof applied to the substrate. Thus coated, the substrate was dried at 150° C. for about 1 minute. Next, using a high-pressure jet-dyeing machine, the substrate was processed in warm water at 130° C. for 60 minutes while dyed with a disperse dye of dark brown, then washed, reduced, oxidized, neutralized and further washed with warm water, and thereafter this was dried at 130° C. while tentered by 10% of the original width. Regarding its dimension based on the original dimension before the dyeing treatment, the thus-processed sheet was shrunk by 3% in the machine direction and by 5% in the cross direction. Using a crumpling machine that simulates hand crumpling, this was mechanically crumpled to be a leather-like sheet.

The abrasion loss of the surface of the obtained leather-like sheet was measured according to a Martindale method. In 10,000 cycles, the loss was 4 mg, and the surface was not pilled at all. However, a major part of the surface of the leather-like sheet was a grainy part of the nonporous elastic polymer and the proportion of the napped part of the ultrafine fibers was much reduced as compared with that in Example 1. Specifically, most of the surface of the sheet was the grainy part and it was difficult to find out the napped part in the surface of the sheet. Though the sheet had a three-dimensional solid feel, its shrinks were large. In addition, since the surface of the sheet was extremely tough as compared with the substrate layer thereof, the sheet did not have a good balance of touch and feel. The sheet could not be a nubuck-type one but was rather similar to a leather-like sheet having a grain type appearance. Observing the cross section of the sheet with an electronic microscope confirmed that the nonporous urethane emulsion reached the depth of from 30 to 50 μm of the substrate layer from the surface thereof, and the mean penetration depth was 41 μm. In the penetration part, the nonporous urethane emulsion was mixed with the polyurethane resin and the ultrafine fibers existing inside the substrate layer.

INDUSTRIAL APPLICABILITY

Having a specific leather-like sheet structure, the sheet of the invention is a nubuck-type leather-like sheet of good surface abrasion resistance. The sheet-has a soft hand of fulfillment and has an elegant three-dimensional appearance. This is usable for high-quality clothes, shoes, especially for automobile sheets and interiors as the artificial leather.

The invention claimed is:

1. An artificial leather sheet which comprises a napped part of ultrafine fibers and a grainy part of nonporous elastic polymer randomly existing in the surface of a substrate, wherein the grainy part may optionally include a portion of the napped ultrafine fibers taken into said nonporous elastic polymer, prepared by infiltrating a porous polymer elastomer into a three-dimensionally intermingled nonwoven fabric of ultrafine fibers of not more than 0.5 dtex, wherein the napped part and the grainy part are on the same surface of the substrate, wherein the nonporous elastic polymer is infiltrated into the substrate and is present from the surface of the substrate to a depth thereof of at least 5 μm and not more than 20 μm.

2. The artificial leather sheet as claimed in claim 1, wherein most of the grainy part includes a portion of the napped ultrafine fibers taken into said nonporous elastic polymer.

3. The artificial leather sheet as claimed in claim 1, wherein the areal ratio of the grainy part to the napped part, grainy part/napped part is from 90/10 to 50/50.

4. The artificial leather sheet as claimed in claim 1, of which the surface abrasion loss is at most 10 mg in 10,000 cycles in a Martindale method.

5. The artificial leather sheet as claimed in claim 1, wherein the fineness of the ultrafine fibers are at most 0.2 dtex.

6. The artificial leather sheet as claimed in claim 1, wherein the porous polymer elastomer comprises a polyurethane resin.

7. The artificial leather sheet as claimed in claim 1, wherein the ratio by weight of the ultrafine fibers to the porous polymer elastomer is from 30/70 to 95/5.

8. The artificial leather sheet as claimed in claim 7, wherein said ratio is from 50/50 to 90/10.

9. The artificial leather sheet as claimed in claim 1, wherein the nonporous elastic polymer is obtained from an aqueous polyurethane emulsion.

10. The artificial leather sheet as claimed in claim 1, wherein the nonporous elastic polymer is infiltrated into the substrate and is present from the surface of the substrate to a depth thereof of at least 10 μm and not more than 15 μm.

11. The artificial leather sheet as claimed in claim 1, wherein the nonporous elastic polymer penetrates into the space between the fibers and the porous polymer elastomer in the substrate layer and into the space of the porous polymer elastomer.

12. A method for producing the artificial leather sheet as claimed in claim 1, comprising the following <1> to <3> in the order of <1>, <2> and <3>:

<1> applying a penetrant to the napped surface of a substrate comprising a nonwoven fabric of three-dimensionally intermingled ultrafine fibers of not more than 0.5 dtex and a porous polymer elastomer infiltrated into it;

<2> discontinuously applying an aqueous emulsion of an elastic polymer to the penetrant-processed napped surface followed by dry-solidifying it in a nonporous state;

<3> processing the resulting artificial leather sheet in warm water to make it shrunk at the shrinkage rate from 2 to 10% both in the direction of length and in the transverse direction thereof.

* * * * *